US010933266B1

(12) United States Patent
Hedeen

(10) Patent No.: US 10,933,266 B1
(45) Date of Patent: Mar. 2, 2021

(54) QUICK MOUNT COMPRESSOR UNIT FOR DRY PIPE SPRINKLER SYSTEM

(71) Applicant: Jason Paul Hedeen, Wayzata, MN (US)

(72) Inventor: Jason Paul Hedeen, Wayzata, MN (US)

( * ) Notice: Subject to any disclaimer, the term of this patent is extended or adjusted under 35 U.S.C. 154(b) by 351 days.

(21) Appl. No.: 15/677,652

(22) Filed: Aug. 15, 2017

Related U.S. Application Data

(60) Provisional application No. 62/501,346, filed on May 4, 2017, provisional application No. 62/375,686, filed on Aug. 16, 2016.

(51) Int. Cl.

| | |
|---|---|
| ***A62C 35/62*** | (2006.01) |
| ***A62C 35/68*** | (2006.01) |
| ***F04B 49/02*** | (2006.01) |
| ***A62C 35/64*** | (2006.01) |
| ***F04B 23/02*** | (2006.01) |

(52) U.S. Cl.
CPC ..... *A62C 35/62* (2013.01); *A62C 35/68* (2013.01); *F04B 49/022* (2013.01); *A62C 35/645* (2013.01); *F04B 23/02* (2013.01); *F04B 2207/042* (2013.01)

(58) Field of Classification Search
CPC ..... A62C 13/78; A62C 35/645; A62C 35/62; F16K 15/06; F41B 11/723; F04B 23/02; F04B 49/022; F04B 2207/042
See application file for complete search history.

(56) References Cited

U.S. PATENT DOCUMENTS

| | | | | |
|---|---|---|---|---|
| 3,401,751 A | | 9/1968 | Loftin | |
| 3,834,462 A | | 9/1974 | Orloff et al. | |
| 3,955,900 A | * | 5/1976 | Vinci | F04B 39/12 417/361 |

(Continued)

OTHER PUBLICATIONS

Guy Parker, Dry Pipe Sprinkler Compressor, Sep. 2015 (Year: 2015).*

(Continued)

*Primary Examiner* — Nathan C Zollinger
(74) *Attorney, Agent, or Firm* — Sherrill Law Offices, PLLC

(57) ABSTRACT

An assembly of a mounting bracket configured and arranged for mounting upon a vertical surface, and a consolidated dry sprinkler compressor unit configured and arranged for hanging engagement upon the mounting bracket after the mounting bracket has been mounted upon a vertical surface. The consolidated dry sprinkler compressor unit including a mounting rail, an air compressor mounted on the rail, a pressure tank mounted on the rail and in fluid communication with the air compressor for receiving air pressurized by the air compressor, a pressure sensor in fluid communication with compressed air in the pressure tank for generating a low pressure signal when the pressure in the pressure tank falls below a threshold value, and a pressure switch in electrical communication with the pressure sensor and the air compressor for activating the air compressor upon receipt of the low pressure signal from the pressure sensor so as to supply the pressure tank with additional pressurized air.

8 Claims, 8 Drawing Sheets

(56) References Cited

U.S. PATENT DOCUMENTS

| | | | | |
|---|---|---|---|---|
| 5,099,925 | A * | 3/1992 | Glidden | A62C 35/64 169/17 |
| 5,971,080 | A * | 10/1999 | Loh | A62C 35/66 169/17 |
| 6,495,777 | B1 * | 12/2002 | Chou | H01H 35/2635 200/83 J |
| 7,703,777 | B2 * | 4/2010 | Horn, Jr. | B62B 5/0013 280/47.34 |
| 8,297,370 | B2 * | 10/2012 | Wilkins | A62C 35/645 169/17 |
| 8,327,946 | B1 | 12/2012 | Silva, Jr. et al. | |
| 8,469,112 | B1 | 6/2013 | Silva, Jr. et al. | |
| 8,528,653 | B1 | 9/2013 | Silva, Jr. et al. | |
| 8,746,356 | B1 | 6/2014 | Silva, Jr. et al. | |
| 2004/0000337 | A1 * | 1/2004 | Cooper | F16K 15/18 137/377 |
| 2013/0168109 | A1 * | 7/2013 | Kochelek | A62C 35/68 169/17 |

OTHER PUBLICATIONS

XZT Pressure Controller (https://www.amazon.com/XZT-230PSI-NPT-Pressure-Controller-Compressor/dp/B077X9H64P, date first available Aug. 1, 2016) (Year: 2016).*

* cited by examiner

QUICK MOUNT COMPRESSOR UNIT FOR DRY PIPE SPRINKLER SYSTEM

BACKGROUND

A dry pipe sprinkler system is a fire suppression sprinkler system in which pipes are filled with a pressurized gas rather than water. The gas holds a remote valve, known as a dry pipe valve, in a closed position. Located in a heated space, the dry-pipe valve prevents water from entering the pipe until a fire causes one or more sprinklers to operate. Once this happens, the gas escapes and the dry pipe valve is released. Water then enters the pipe, flowing through open sprinklers and onto the fire.

Gas pressure is maintained within the pipes by a compressor unit, which monitors the pressure within the pipes and increases the pressure within the pipes whenever the pressure falls below a threshold minimum pressure.

On-site installation and setting of a dry pipe sprinkler system compressor unit is often a complicated and cumbersome task, particularly when the compressor unit is all too often installed in a cramped and congested utility or storage room.

Accordingly, a substantial need exists for a system that allows quick, easy, stable and secure installation of a compressor unit into operable engagement with a dry sprinkler system, and subsequent setting and adjustment of the unit. The system should also provide for quick and easy dismounting of the compressor unit should maintenance, repairs or replacement be desired or required.

SUMMARY OF THE INVENTION

A first aspect of the invention is an assembly comprising separate and independent components of a mounting bracket configured and arranged for mounting upon a vertical surface, and a consolidated dry sprinkler compressor unit. The consolidated dry sprinkler compressor unit includes at least (-) a mounting rail configured and arranged for hanging engagement upon the mounting bracket after the mounting bracket has been mounted upon a vertical surface, (-) an air compressor mounted on the rail, (-) a pressure tank mounted on the rail and in fluid communication with the air compressor for receiving air pressurized by the air compressor, (-) a pressure sensor in fluid communication with compressed air in the pressure tank for generating a low pressure signal when the pressure in the pressure tank falls below a threshold value, and (-) a pressure switch in electrical communication with the pressure sensor and the air compressor for activating the air compressor upon receipt of the low pressure signal from the pressure sensor so as to supply the pressure tank with additional pressurized air.

A second aspect of the invention is a consolidated dry sprinkler compressor unit, comprising (-) a rail, (-) an air compressor mounted on the rail, (-) a pressure tank mounted on the rail and in fluid communication with the air compressor for receiving air pressurized by the air compressor, and (-) an adjustable differential pressure switch in fluid communication with compressed air in the pressure tank and in communication with the air compressor for activating the air compressor upon sensing a pressure in the pressure tank at or below a preset minimum pressure value and deactivating the air compressor upon sensing a pressure in the pressure tank at or above a preset maximum pressure value. The pressure switch is operable for user input, adjustment and visual display during user input or adjustment of at least two pressure values selected from (i) a minimum pressure value, (ii) a maximum pressure value, and (iii) a pressure differential between a minimum pressure value and a maximum pressure value.

DETAILED DESCRIPTION OF A PREFERRED EMBODIMENT

Nomenclature Table

Figure 1:
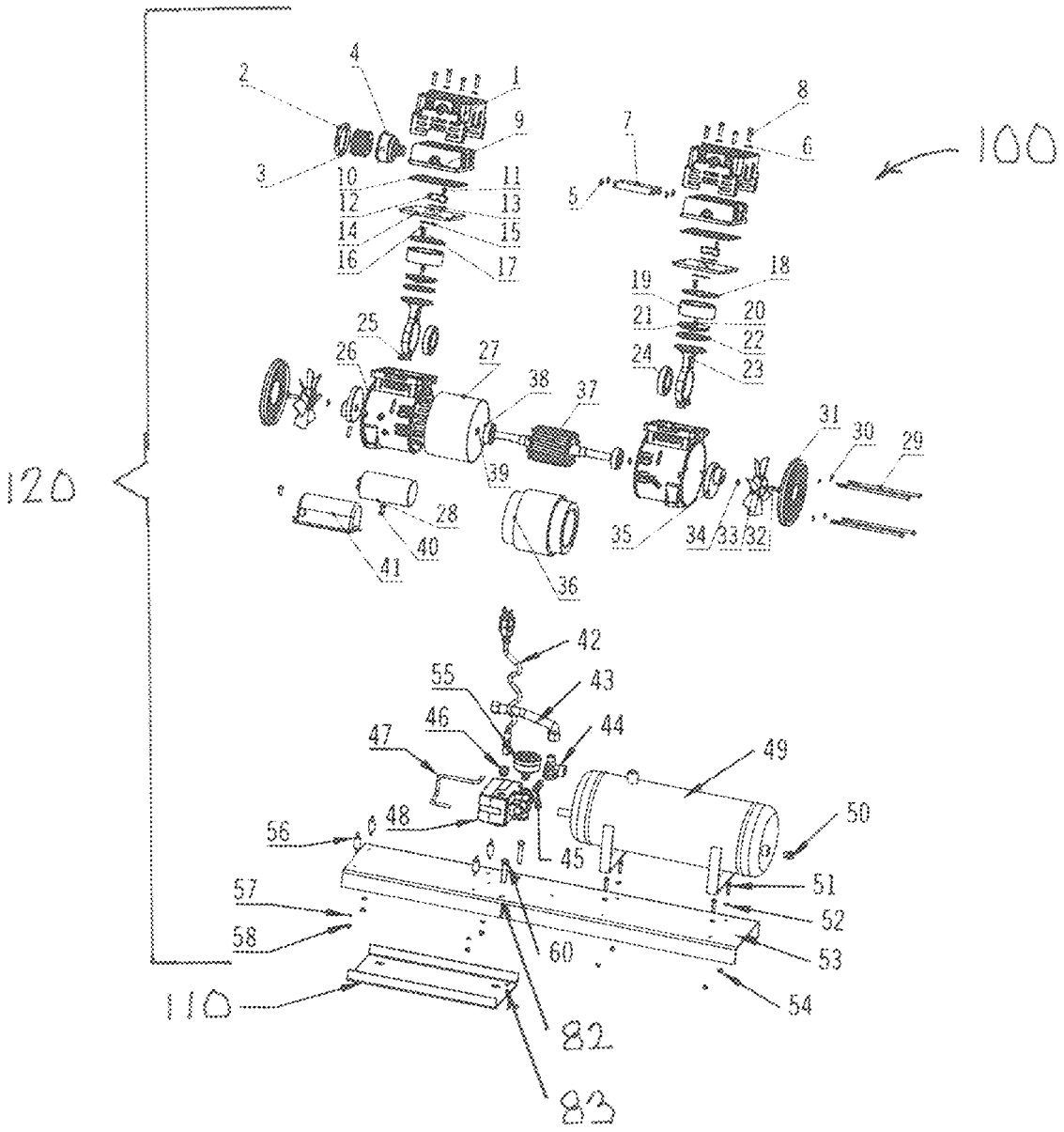
FIG. 1 is an exploded perspective view of one embodiment of the invention.

1 Plastic Cover
2 Filter Cover
3 Filter Element
4 Filter Base
5 O-rings (qty 4)
6 Gasket (qty 12)
7 Pipe
8 Socket Screw (qty 12)
9 Cylinder Head (qty 2)
10 Gasket or Rubber Mat (qty 2)
11 Screw (qty 2)
12 Locking Block (qty 2)
13 Valve Plate (qty 2)
14 Valve Disc (qty 2)
15 Valve Plate (qty 2)
16 Washer (qty 2)
17 Screw (qty 2)
18 O-ring (qty 2)
19 Cylinder (qty 2)
20 Screw (qty 2)
21 Pressure Plate (qty 2)
22 Piston Ring (qty 2)
23 Connecting Rod (qty 2)
24 Bearing (qty 2)
25 Socket Screw (qty 2)
26 Crank Case (qty 2)
27 Bushing
28 Capacitor
29 Stud (qty 4)
30 Spring Washer (qty 4)
31 Protecting Cover (qty 2)
32 Screw (qty 4)
33 Fan Blade (qty 2)
34 Outside Spring (qty 2)
35 Crank Throw (qty 2)
36 Stator
37 Rotor

38 Bearing (qty 2)
39 Outside Spring (qty 2)
40 Screw (qty 2)
41 Capacitor Cover
42 Power Cord
43 Metal Hose
44 Check Valve
45 Safety Valve
46 Strain Relief Wire Clasps
47 Tube
48 Pressure Switch
49 Tank
50 Drain Valve
51 Screw (qty 2 or 4)
52 Washers (qty 2 or 4)
53 Mounting Plate or Rail
54 Nuts (qty 2 or 4)
55 Pressure Gauge
56 Shock Pad or Vibration Dampener (qty 4)
57 Washers (qty 4)
58 Nuts (qty 4)
60 Screw (qty 2)
61 Connection Box
62 Connection Box Cover
63 Bolts (qty 8)
64 Washers (qty 8)
65 Terminal Screw
66 Elbow
67 Bolt (qty 2)
68 Washers (qty 8)
69 Bolt (qty 2)
70 Washers (qty 2)
71 Wiring Terminal
72 Digital Pressure Switch
73 Solenoid Valve
74 Studs (qty 2)
75 Tank
81 Left and Right Hang Tabs on Mounting Plate/Rail (qty 2)
82 Holes Through Mounting Plate/Rail (qty 2)
83 Threaded Holes In Mounting Bracket (qty 2)
100 Assembly
110 Mounting Bracket
120 Consolidated Dry Sprinkler Compressor Unit
200 Air Pressure Maintenance Device
R Riser
S Dry Sprinkler System
SD Dry Pipes
Sw Water Pipes
V Dry Pipe Valve

DESCRIPTION

Construction

Figure 3:
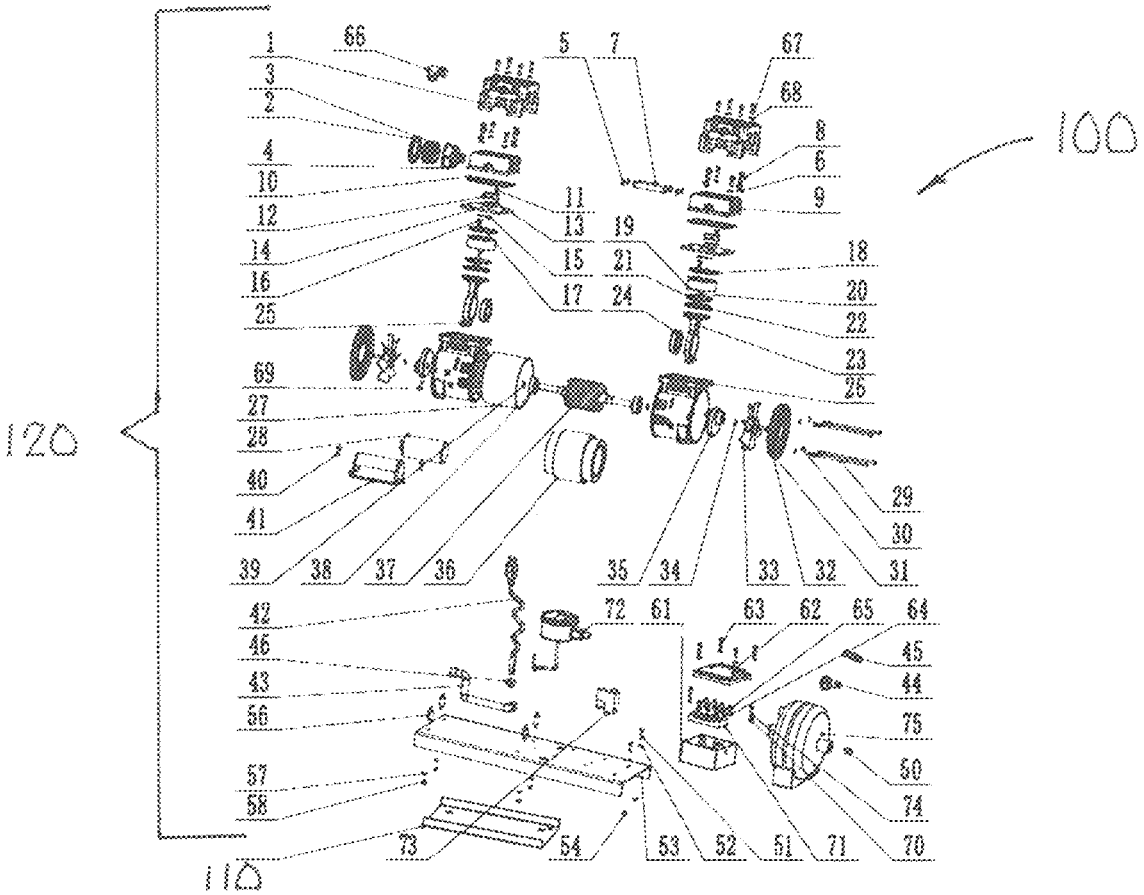
FIG. 3 is an exploded perspective view of another embodiment of the invention.
Figure 4:
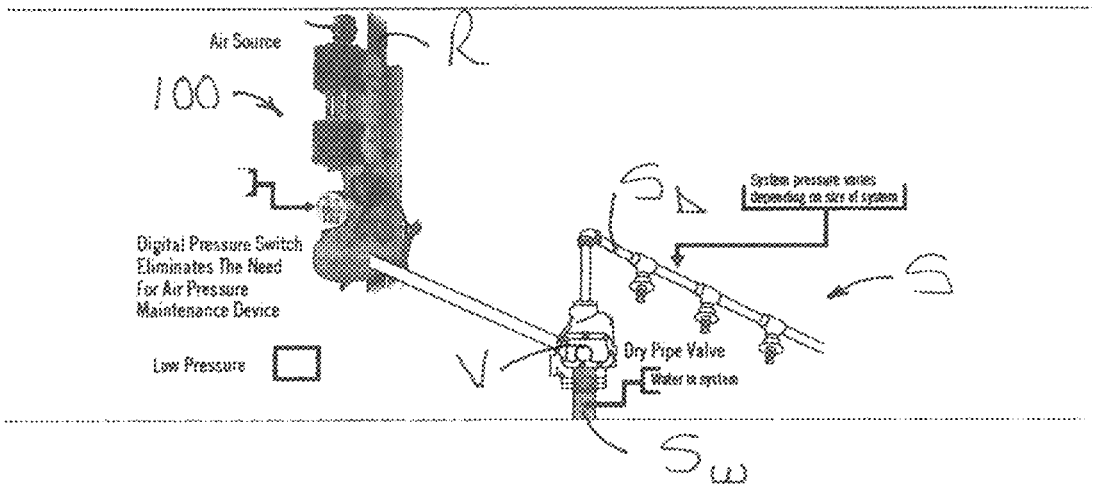
FIG. 4 is a perspective view of the invention depicted in FIG. 3 mounted to a riser and in operable communication with a dry pipe sprinkler system.
Figure 5A:
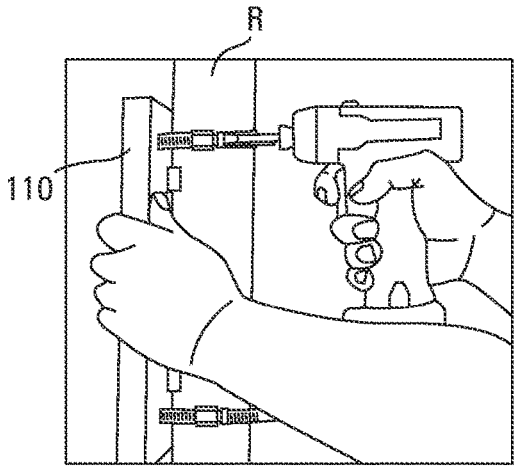
FIGS. 5A, 5B, 5C and 5D depict the steps of mounting an embodiment of the invention onto a riser.
Figure 6A:
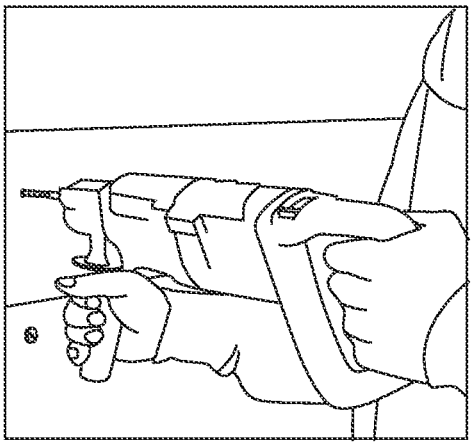
FIGS. 6A, 6B, 6C, 6D, 6E, 6F, 6G, 6H and 6I depict the steps of mounting an embodiment of the invention onto a cinder block or concrete wall.
Figure 6B:
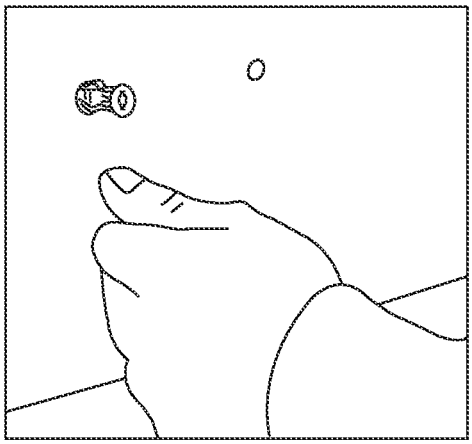
Figure 6C:
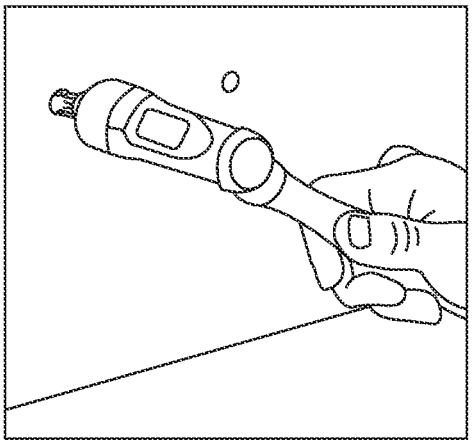
Figure 6D:
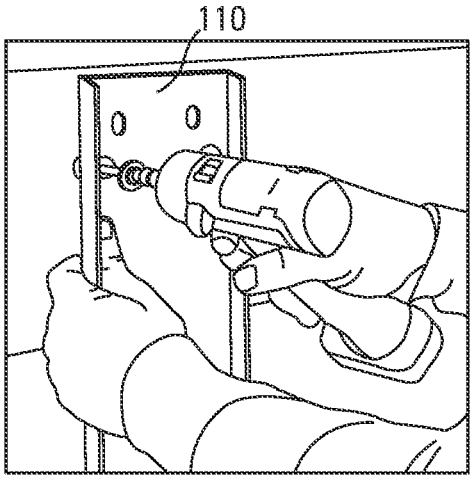
Figure 7A:
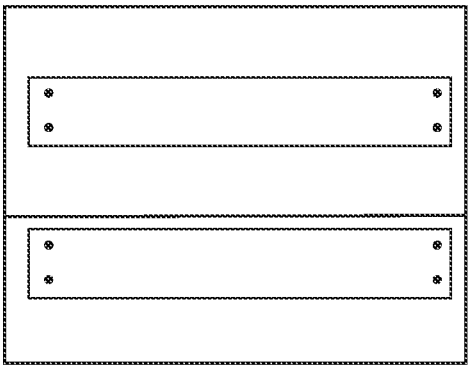
FIGS. 7A, 7B, 7C, 7D, 7E and 7F depict the steps of mounting an embodiment of the invention onto a drywall wall.
Figure 7B:
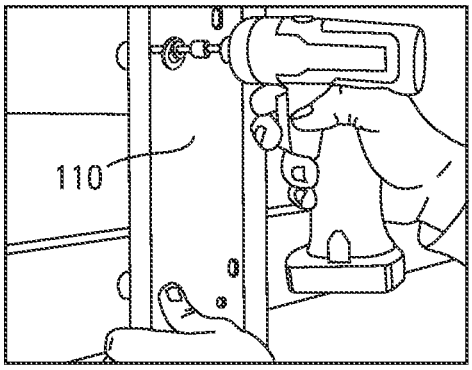

Referring to FIGS. 1, 2, 3 and 4, the invention is an assembly 100 of a mounting bracket 110 configured and arranged for mounting upon a vertical surface (unnumbered) such as depicted in FIGS. 5A, 6D and 7B, and a consolidated dry sprinkler compressor unit 120. The assembly 100 is configured and arranged for use with a dry pipe sprinkler system S.

The consolidated dry sprinkler compressor unit 120 includes (i) a mounting plate or rail 53, (ii) an air compressor (components 1-41 depicted in each of FIG. 1 and components 1-41 and 66-69 in FIG. 3, and collectively referenced hereinafter as AC), (iii) a pressure tank (49 in FIGS. 1 and 75 in FIG. 3), (iv) a pressure sensor (55 in FIG. 1 and unnumbered in FIG. 3), and (v) a pressure switch (48 in FIGS. 1 and 72 in FIG. 3).

Figure 5B:
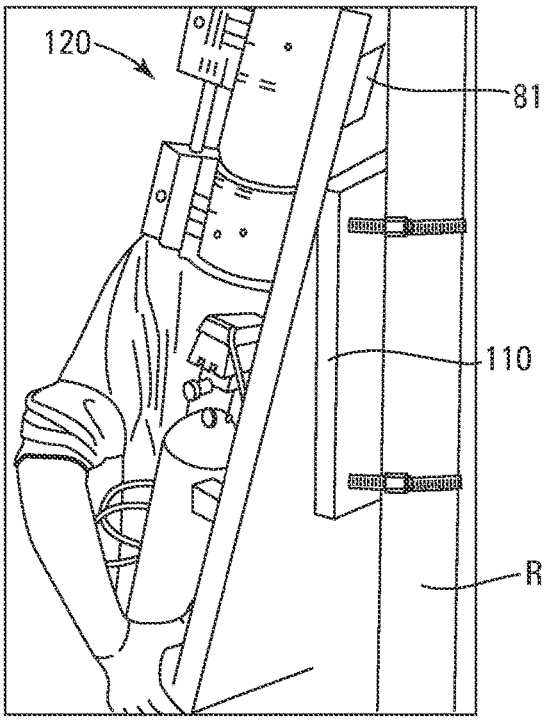
Figure 5C:
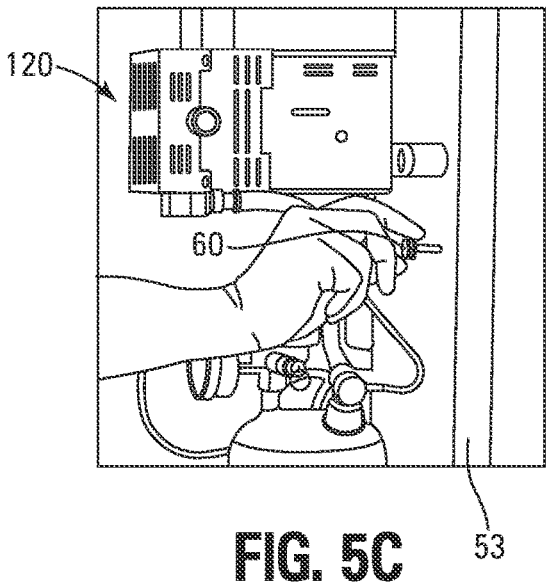
Figure 6E:
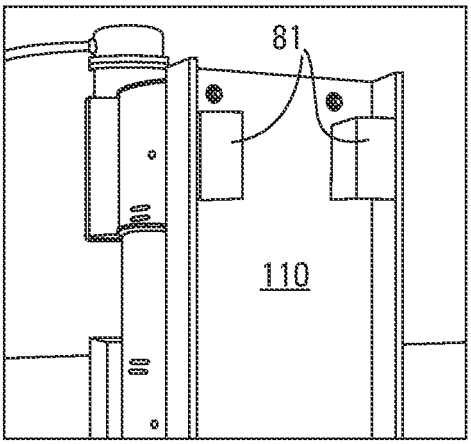

The mounting plate or rail 53 is configured and arranged for hanging engagement upon the mounting bracket 110, such as by left and right hang tabs 81 located on the back side and proximate one end of mounting plate or rail 53 as depicted in FIGS. 5B and 6E, after the mounting bracket 110 has been mounted upon a vertical surface such as a riser R. The mounting plate or rail 53 is then preferrably bolted to the mounting bracket 110, such as by screws 60 inserted through holes 82 in the mounting plate or rail 53 which are aligned with threaded holes 83 in the mounting bracket 110, depicted in FIGS. 1, 5C, 6G and 6H, and 7D and 7E.

The air compressor AC is mounted upon the rail 53, such as by threaded vibration dampeners 56, washers 57 and nuts 58.

The pressure tank (49 in FIGS. 1 and 75 in FIG. 3) is mounted on the rail 53, such as by screws 51, washers 52 and nuts 54, and in fluid communication with the air compressor AC, such as via a metal hose 43 equipped with a check valve 44, a safety valve 45 and strain relief wire clasps 46, for receiving air pressurized by the air compressor AC. The pressure tank (49 in FIGS. 1 and 75 in FIG. 3) preferably includes a drain valve 50.

The pressure sensor (55 in FIG. 1 and unnumbered in FIG. 3) is fluid communication with compressed air in the pressure tank (49 in FIGS. 1 and 75 in FIG. 3), such as via tube 47, for generating a low pressure signal when the pressure in the pressure tank (49 in FIGS. 1 and 75 in FIG. 3) falls below a threshold value.

The pressure switch (48 in FIGS. 1 and 72 in FIG. 3) is in electrical communication with the pressure sensor (55 in FIG. 1 and unnumbered in FIG. 3) and the air compressor AC for activating the air compressor AC upon receipt of the low pressure signal from the pressure sensor (55 in FIG. 1 and unnumbered in FIG. 3) so as to supply the pressure tank (49 in FIGS. 1 and 75 in FIG. 3) with additional pressurized air.

In a preferred embodiment, depicted in FIG. 3, the pressure sensor (unnumbered in FIG. 3) and pressure switch 72 are consolidated in an adjustable digital differential pressure switch (components 61-65 and 70-74 depicted in FIG. 3 and collectively referenced hereinafter as DS).

Referring to FIG. 3, the adjustable digital differential pressure switch DS is in fluid communication with compressed air in the pressure tank 75 and in communication with the air compressor AC for activating the air compressor AC upon sensing a pressure in the pressure tank 75 at or below a preset minimum pressure value, and deactivating the air compressor AC upon sensing a pressure in the pressure tank 75 at or above a preset maximum pressure value. The adjustable digital differential pressure switch DS is preferably operable for user input, adjustment and visual display during user input or adjustment of at least two pressure values selected from (i) a minimum pressure value, (ii) a maximum pressure value, and (iii) a pressure differential between a minimum pressure value and a maximum pressure value.

In a most preferred embodiment, the adjustable digital differential pressure switch DS has a mandated and default pressure differential of at least 4 psi, preferrably between 4 and 20 psi, and most preferably between 4 and 10 psi.

Specification details for one preferred embodiment of the consolidated dry sprinkler compressor unit 120 is provided below in Table One.

TABLE ONE

| FIRST PREFERRED EMBODIMENT | |
|---|---|
| HP | 1 |
| SYSTEM CAPACITY | 40 PSI 260 GALLONS<br>20 PSI 520 GALLONS<br>10 PSI 1040 GALLONS |
| PRESSURE SWITCH | ON @ 55 PSI, OFF @ 120 PSI |
| CFM | 2.35 @ 90 PSI |
| PUMP | 2 CYLINDER, OIL FREE |
| CYLINDERS | CERAMIC COMPOSITE |
| VOLTS | 115 |
| PHASE | 1 |
| TANK SIZE | 1 GALLON |
| OUTLET | ½" NPT |
| DIMENSIONS | 36" × 10.5" × 7" |
| WEIGHT | 42 LBS. |

Specification details for another preferred embodiment of the consolidated dry sprinkler compressor unit 120 is provided below in Table Two.

TABLE TWO

| SECOND PREFERRED EMBODIMENT | |
|---|---|
| HP | 1 |
| SYSTEM CAPACITY | 40 PSI 261 GALLONS<br>20 PSI 522 GALLONS<br>10 PSI 1200 GALLONS |
| PRESSURE SWITCH | ADJUSTABLE: 5-55 PSI<br>Factory Set at 15-20 PSI<br>Minimum Differential: 5 PSI |
| CFM | 3.68 @ 10 PSI |
| PUMP | 2 CYLINDER, OIL FREE |
| CYLINDERS | CERAMIC COMPOSITE |
| VOLTS | 115 |
| PHASE | 1 |
| OUTLET | ¾" NPT |
| DIMENSIONS | 27" × 10.5" × 7" |
| WEIGHT | 38 LBS. |

Installation and Use

The consolidated dry sprinkler compressor unit 120 can be quickly, easily, stably and securely mounted onto a vertical surface, placed into operable engagement with a dry sprinkler system S, and then set and adjusted for providing proper pressurization to the dry side of a dry pipe valve V.

Figure 5D:
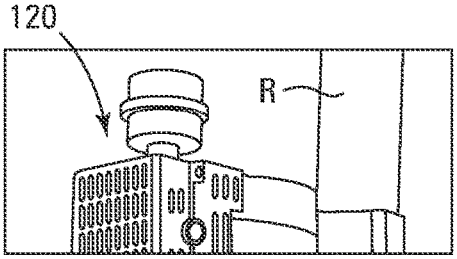

Mounting of the consolidated dry sprinkler compressor unit 120 to a riser R is depicted in FIGS. 5A-D. First, as depicted in FIG. 5A, the mounting bracket 110 is secured to a riser R, such as with ring clamps, proximate a dry pipe valve V in a dry sprinkler system S. Next, as depicted in FIG. 5B, the consolidated dry sprinkler compressor unit 120 is hung upon the mounting bracket 110 by sliding the hang tabs 81 on the backside of the rail 53 down onto the mounting bracket 110. As depicted in FIG. 5C, the consolidated dry sprinkler compressor unit 120 can then be bolted onto the mounting bracket 110 by inserting screws 60 through holes 82 in the rail 53 and threading the screws 60 into the aligned threaded holes 83 in the mounting bracket 110. Finally, as depicted in FIG. 5*d*, the filter assembly 2, 3, 4 with attached power cord 42 may be installed onto the top of the air compressor AC and the power cord plugged into an electrical outlet.

Figure 6F:
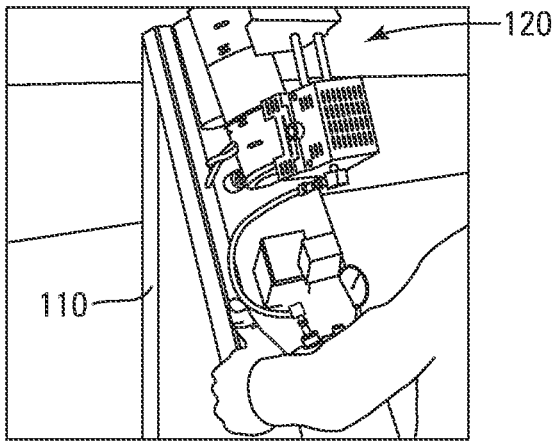
Figure 6G:
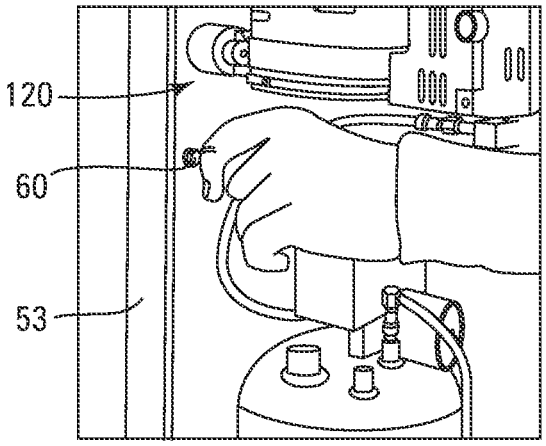
Figure 6H:
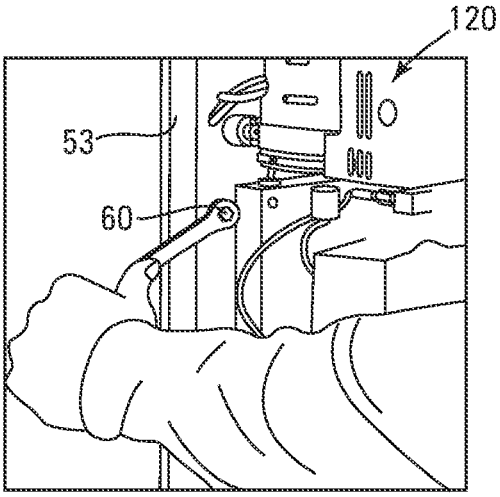
Figure 6I:
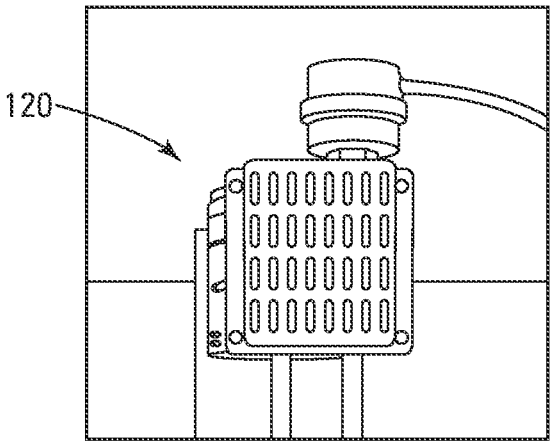

Mounting of the consolidated dry sprinkler compressor unit 120 to a concrete or cinder block wall (unnumbered) is depicted in FIGS. 6A-I. First, as depicted in FIGS. 6A-D, the mounting bracket 110 is secured to a concrete or cinder block wall (unnumbered) proximate a dry pipe valve V in a dry sprinkler system S by drilling properly spaced holes into the concrete or cinder block wall, inserting anchors (unnumbered) into the holes, and bolting the mounting bracket 110 to the concrete or cinder block wall at the wall anchors. Next, as depicted in FIG. 6F, the consolidated dry sprinkler compressor unit 120 is hung upon the mounting bracket 110 by sliding the hang tabs 81 on the backside of the rail 53 down onto the mounting bracket 110. As depicted in FIGS. 6G and H, the consolidated dry sprinkler compressor unit 120 can then be bolted onto the mounting bracket 110 by inserting screws 60 through holes 82 in the rail 53 and threading the screws 60 into the aligned threaded holes 83 in the mounting bracket 110. Finally, as depicted in FIG. 61, the filter assembly 2, 3, 4, with attached power cord 42 may be installed onto the top of the air compressor AC and the power cord plugged into an electrical outlet.

Figure 7C:
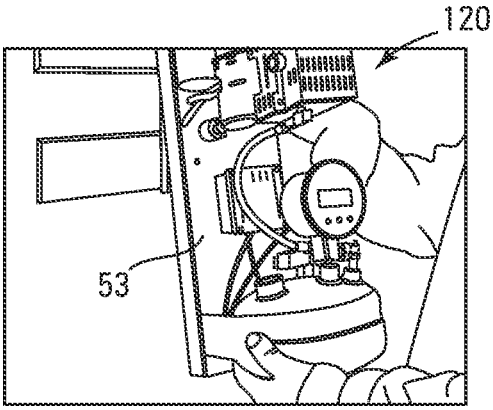
Figure 7D:
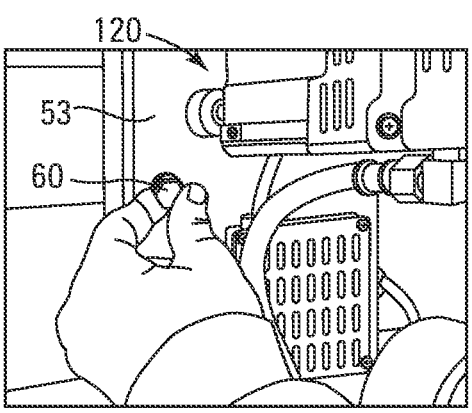
Figure 7E:
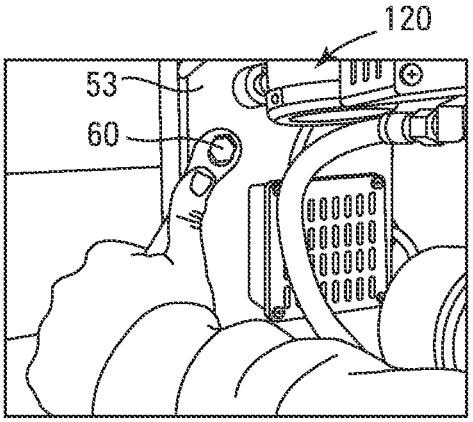
Figure 7F:
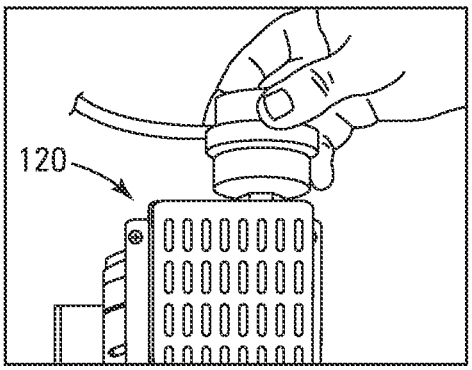

Mounting of the consolidated dry sprinkler compressor unit 120 to a drywall wall (unnumbered) is depicted in FIGS. 7A-F. First, as depicted in FIG. 7A, wooden or metal mounting board(s) (unnumbered) are nailed or screwed to the wall studs (not shown) proximate a dry pipe valve V in a dry sprinkler system S. Next, as depicted in FIG. 7B, the mounting bracket 110 is secured to the mounting board(s) with screws (unnumbered). Next, as depicted in FIG. 7C, the consolidated dry sprinkler compressor unit 120 is hung upon the mounting bracket 110 by sliding the hang tabs 81 on the backside of the rail 53 down onto the mounting bracket 110. As depicted in FIGS. 7D and E, the consolidated dry sprinkler compressor unit 120 can then be bolted onto the mounting bracket 110 by inserting screws 60 through holes 82 in the rail 53 and threading the screws 60 into the aligned threaded holes 83 in the mounting bracket 110. Finally, as depicted in FIG. 7F, the filter assembly 2, 3, 4, with attached power cord 42 may be installed onto the top of the air compressor AC and the power cord plugged into an electrical outlet.

Figure 2:
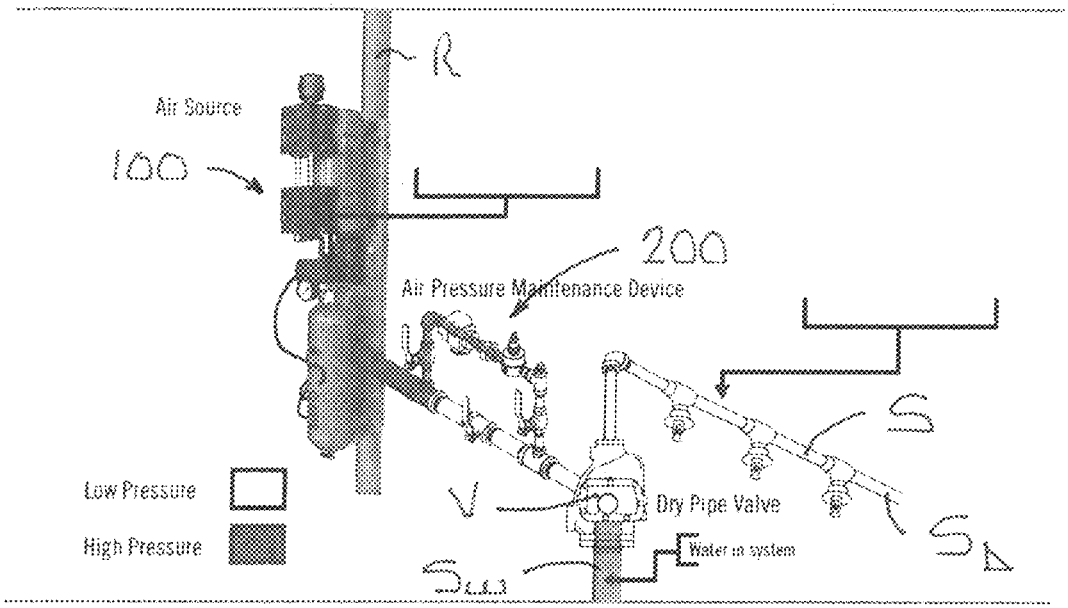
FIG. 2 is a perspective view of the invention depicted in FIG. 1 mounted to a riser and in operable communication with a dry pipe sprinkler system.

Referring to FIGS. 2 and 4, the tank (49 in FIGS. 1 and 75 in FIG. 3) is placed in fluid communication with the dry side of a dry pipe valve V for filling the dry pipes SD with pressurized gas at a pressure sufficient to keep the dry pipe valve V closed. Of course, when one or more sprinklers (unnumbered) on the dry pipes SD is opened the pressurized gas escapes, the dry pipe valve V opens, and pressurized water from the water pipes Sw in fluid communication with the wet side of the dry pipe valve V flows into the dry pipes SD and out through the open sprinkler(s).

The threshold pressures at which the pressure switch (48 in FIGS. 1 and 72 in FIG. 3) activates and deactivates the air compressor AC to maintain an appropriate pressure within the pressure tank (49 in FIGS. 1 and 75 in FIG. 3) may be set mechanically or by input to a microcontroller (not shown).

Referring to FIG. 1, mechanical setting of the pressure threshold values may be made by mechanical rotation of an adjustment screw (not individually shown) on the pressure switch 48 until readings from the pressure gauge 55 in fluid communication with the pressure tank 49, taken at times of activation and deactivation, indicate achievement of desired threshold settings. An air pressure maintenance device 200, such at that depicted in FIG. 2, may need to be employed when a mechanical control system such as depicted in FIGS. 1 and 2 is employed.

Referring to FIG. 3, programmed setting and control of the pressure threshold values may be made by inputting the desired values to an onboard microcontroller (not individually shown) in electrical communication with the pressure switch 72. By way of example, the adjustable digital differential pressure switch DS may be equipped with a display and three input buttons (not shown) labeled mode, up arrow and down arrow. An initial pressing of the mode button displays a request for input of a maximum threshold pressure value at which the air compressor AC will be shut off. The up arrow and down arrow are used to set this value. Pressing of the mode button again sets the maximum threshold pressure value, and displays a request for input of a minimum threshold pressure value at which the air compressor AC will be turned on. The up arrow and down arrow are used to set this value. Use of an adjustable digital differential pressure switch DS dispenses with the need for an air pressure maintenance device 200 such as depicted in FIG. 2. In a preferred embodiment, the microcontroller is preprogrammed with a default minimum pressure differential between the minimum and maximum and threshold pressure values (e.g., a mandated pressure differential of at least 4 psi, preferably a mandated pressure differential of between 4 and 20 psi, and most preferably a mandated pressure differential of between 4 and 10 psi) so as to prevent setting of the minimum and maximum and threshold pressure values too close to one another in order to avoid excessive wear resulting from overly frequent activation of the air compressor AC.

In another example, the adjustable digital differential pressure switch DS may be equipped with a display and three input buttons (not shown) labeled mode, up arrow and down arrow. An initial pressing of the mode button displays a request for input of a minimum threshold pressure value at which the air compressor AC will be turned on. The up arrow and down arrow are used to set this value. Pressing of the mode button again sets the minimum threshold pressure value, and displays a request for input of a pressure differential between the selected minimum and a maximum threshold pressure value, thereby setting the maximum threshold pressure value at which the air compressor AC will be turned off. The up arrow and down arrow are used to set this value. In a preferred embodiment, the microcontroller is preprogrammed to prevent setting of the pressure differential too tightly (e.g., a mandated pressure differential of at least 4 psi, preferably a mandated pressure differential of between 4 and 20 psi, and most preferably a mandated pressure differential of between 4 and 10 psi) to avoid excessive wear resulting from overly frequent activation of the air compressor AC.

The microcontoller may be programmed to allow locking and unlocking of the pressure setting feature, and may be programmed to allow monitoring and display of the amps voltage of the electrical current to the air compressor AC.

I claim:

1. A kit, comprising separate and independent components of:

a mounting bracket configured and arranged for mounting upon a vertical structure, and a consolidated dry sprinkler compressor unit, wherein the consolidated dry sprinkler compressor unit includes at least:

(i) a mounting rail configured and arranged for drop-down hanging engagement upon the mounting bracket after the mounting bracket has been mounted upon the vertical structure, (ii) an air compressor mounted on the rail, (iii) a pressure tank mounted on the rail and in fluid communication with the air compressor for receiving air pressurized by the air compressor, (iv) a pressure sensor in fluid communication with compressed air in the pressure tank for generating a low pressure signal when the pressure in the pressure tank falls below a threshold value, and (v) a pressure switch in electrical communication with the pressure sensor and the air compressor for activating the air compressor upon receipt of the low pressure signal from the pressure sensor so as to supply the pressure tank with additional pressurized air.

2. The kit of claim 1 wherein the kit further comprises: (A) a set of orifices through the mounting bracket and a corresponding set of orifices through the mounting rail, configured and arranged for paired alignment with one another when the mounting rail is hung from the mounting bracket, and (B) fasteners configured and arranged for passage through each of the aligned paired orifices for securing the mounting rail to the mounting bracket.

3. The kit of claim 1 wherein the mounting bracket is configured and arranged for mounting upon a riser.

4. The kit of claim 1 wherein the kit is assembled, the consolidated dry sprinkler compressor unit is mounted to a vertical surface of the vertical structure and the pressure tank is in fluid communication with a dry side of a dry pipe valve in a dry pipe sprinkler system.

5. The kit of claim 1, wherein the pressure switch is an adjustable differential pressure switch in fluid communication with compressed air in the pressure tank and in communication with the air compressor for on-off cycling operation of the air compressor between a paired setting of an adjustable minimum pressure value and an adjustable maximum pressure value by activating the air compressor upon sensing a pressure in the pressure tank at or below the set minimum pressure value and deactivating the air compressor upon sensing a pressure in the pressure tank at or above the set maximum pressure value, wherein the pressure switch is operable for user input, adjustment and visual display during user input or adjustment of at least one of the minimum pressure value and the maximum pressure value of at least two pressure values selected from (i) the minimum pressure value, (ii) the maximum pressure value, and (iii) a pressure differential between a minimum pressure value and a maximum pressure value.

6. The kit of claim 5 wherein the pressure switch has a mandated and default pressure differential of at least 4 psi.

7. The kit of claim 5 wherein the pressure switch has a mandated and default pressure differential of between 4 and 20 psi.

8. The kit of claim 5 wherein the pressure switch has a mandated and default pressure differential of between 4 and 10 psi.

* * * * *